United States Patent [19]

Baczuk

[11] 4,061,511

[45] Dec. 6, 1977

[54] ALUMINUM SILICATE STABILIZER IN GAS PRODUCING PROPELLANTS

[75] Inventor: Robert J. Baczuk, Salt Lake City, Utah

[73] Assignee: The United States of America as represented by the Secretary of the Navy, Washington, D.C.

[21] Appl. No.: 710,954

[22] Filed: Aug. 2, 1976

[51] Int. Cl.[2] ..... C06B 45/10

[52] U.S. Cl. ..... 149/19.9; 149/19.1; 149/19.3; 149/19.4; 149/19.8; 149/20; 149/100; 149/108.8; 149/110

[58] Field of Search ..... 149/19.1, 19.3, 19.4, 149/19.8, 19.9, 20, 100, 108.8, 110

[56] References Cited

U.S. PATENT DOCUMENTS

| | | | |
|---|---|---|---|
| 2,967,098 | 1/1961 | Weil | 149/19.8 |
| 3,058,858 | 10/1962 | Batchelder et al. | 149/20 X |
| 3,822,154 | 7/1974 | Lawrence et al. | 149/20 X |
| 3,905,846 | 9/1975 | Berta | 149/19.4 |
| 3,924,405 | 12/1975 | Cohen et al. | 149/20 X |
| 3,969,166 | 7/1976 | Sayle | 149/19.4 |
| 3,979,236 | 9/1976 | Sayle | 149/19.8 |

*Primary Examiner*—Edward A. Miller

*Attorney, Agent, or Firm*—R. S. Sciascia; Charles D. B. Curry

[57] ABSTRACT

The use of an aluminum silicate molecular sieve as a stabilizer in propellants that give off gas during the aging process. An aluminum silicate molecular sieve is added to propellants that give off gases such as $N_2$, $CO_2$, CO, $F_2$ and $NO_x$ during the aging process. The aluminum silicate molecular sieve is selected to have a pore size of less than about 10 angstroms. This brings about absorption of these undesirable gases during the aging process and thereby prevents degradation of the propellant.

1 Claim, No Drawings

ALUMINUM SILICATE STABILIZER IN GAS PRODUCING PROPELLANTS

BACKGROUND OF THE INVENTION

1. Field of the Invention

The present invention relates to propellants that give off gases during the aging process and more particularly to the use of an aluminum silicate molecular sieve as a stabilizer in these propellants to absorb the undesirable gases.

2. Description of the Prior Art

One of the problems encountered in the propellant industry is that many propellants give off gases during the aging process that partially interfer with or destroy the desirable characteristics of the propellant. Propellants where this is encountered include casting powder such as nitrocellulose and nitroglycerin, high energy fluorine propellants, single or double base nitrate ester propellants and composite propellants such as ammonium perchlorate/Al with rubber binders. The undesirable gases that may be given off during this aging process include $N_2$, $CO_2$, CO, $NO_x$ and $F_2$.

The present invention overcomes this problem by absorbing these gases to render them harmless and without degrading the propellant.

SUMMARY OF THE INVENTION

Briefly, the present invention comprises the use of an aluminum silicate molecular sieve as a stabilizer in propellants that give off gas during the aging process. An aluminum silicate molecular sieve is added to propellants that give off gases such as $N_2$, $CO_2$, CO, $F_2$ and $NO_x$ during the aging process. The aluminum silicate molecular sieve is selected to have a pore size of less than about 10 angstroms. This brings about absorption of these undesirable gases during the aging process and thereby prevents degradation of the propellant.

STATEMENT OF THE OBJECTS OF THE INVENTION

An object of the present invention is to provide a propellant that retains its desired characteristics during aging.

Another object of the present invention is to provide a propellant that includes an effective stabilizer that minimizes the retention of harmful gases during the aging process.

Still another object of the present invention is to provide a stabilizer that is particularly effective for propellants that give off gases such as $N_2$, $CO_2$, CO, $NO_x$ and $F_2$ during the aging process.

Other objects, advantages and novel features of the invention will become apparent from the following detailed description of the invention.

DESCRIPTION OF THE PREFERRED EMBODIMENT

In accordance with the present invention an aluminum silicate molecular sieve is used as a stabilizer with propellants that give off gases such as $N_2$, $CO_2$, CO, $F_2$ and $NO_x$ during the aging process. Propellants that give off one or more of the above defined gases during the aging process include casting powders including nitrocelluloe or nitroglycerine, high energy fluorine propellants, double and single base nitrate ester propellants and composite propellants such as ammonium perchlorate/Al with rubber binders and the like. It has been found that when aluminum silicate molecular sieves having a pore size of less than about 10 angstroms are used in the propellant that they effectively remove the above defined gases from the propellant and thereby render their formation during the aging process harmless.

The aluminum silicate (Al, Si, O) molecular sieve may be chemically defined as:

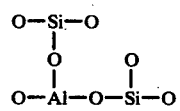

(1)

The most effective aluminum silicate molecular sieve for addition to the gas producing propellant has been found to have a particulate size of less than 10 microns and a pore size of less than about 10 angstroms.

In addition to the ability of the above defined aluminum silicate molecular sieves to remove by absorption gases such as $N_2$, CO and $CO_2$ it also has the ability to disproportionate nitric oxide, a particularly troublesome gas in nitrate ester systems:

$$\underset{\text{nitric oxide}}{4NO} \xrightarrow{\text{Sieve}} N_2O + N_2O_3 \qquad (2)$$

Both the $N_2O$ and $N_2O_3$ are strongly adsorbed by the sieve; however, $N_2O_3$ can be effectively scavenged by conventional stabilizers and $N_2O$ has a high solubility in the propellant in the event that an equilibrium is established between the sieve and the propellant. Also, delayed catalysis can be achieved through chemically preloading sieves with an appropriate catalyst for the binder system used. Loosely bound catalysts are displaced by more polar entities such as nitric acid to increase cure rates to speed up sluggish reactions in latter parts of propellant binder cure cycles.

EXAMPLE

A typical propellant formulation was prepared with the above stabilizers and its composition was as follows:

| | % by weight |
|---|---|
| Propellant (from the (previously defined group) | 99.8 |
| Aluminum Silicate molecular sieve (less than about 10 angstroms pore size) | 0.2 |

What is claimed is:

1. In a solid propellant selected from the group consisting of casting power of nitrocellulose and nitroglycerin, high energy fluorine propellant, single base nitrate ester propellant, double base nitrate ester propellant and ammonium perchlorate/Al with rubber binder propellant, that gives off gases selected from the group consisting of $N_2$, $CO_2$, CO, $F_2$ and $NO_x$ during the aging process, the improvement consisting of an additional ingredient in said propellant of an aluminum silicate molecular sieve having a particulate size of less than about 10 microns, a pore size of less than about 10 angstroms, and in an amount of about 0.2 percent by weight of said propellant.

* * * * *